US010046575B2

(12) United States Patent
Togashi et al.

(10) Patent No.: US 10,046,575 B2
(45) Date of Patent: Aug. 14, 2018

(54) LIQUID SPRAY DEVICE

(71) Applicant: Seiko Epson Corporation, Tokyo (JP)

(72) Inventors: Isamu Togashi, Nagano (JP); Shuji Sugawara, Yamagata (JP); Yoichi Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/560,156

(22) PCT Filed: Mar. 11, 2016

(86) PCT No.: PCT/JP2016/001392
§ 371 (c)(1),
(2) Date: Sep. 20, 2017

(87) PCT Pub. No.: WO2016/152069
PCT Pub. Date: Sep. 29, 2016

(65) Prior Publication Data

US 2018/0093503 A1 Apr. 5, 2018

(30) Foreign Application Priority Data

Mar. 23, 2015 (JP) ..... 2015-058943

(51) Int. Cl.
*B41J 25/308* (2006.01)
*B41J 11/06* (2006.01)
(Continued)

(52) U.S. Cl.
CPC ..... *B41J 11/06* (2013.01); *B41J 2/17566* (2013.01); *B41J 11/005* (2013.01); *B41J 11/42* (2013.01)

(58) Field of Classification Search
USPC ..... 347/8, 16; 400/646, 642; 399/406; 271/188
See application file for complete search history.

(56) References Cited

U.S. PATENT DOCUMENTS 5,356,229 A * 10/1994 Hickman ..... B41J 11/005 271/188
5,393,151 A 2/1995 Martin et al.
(Continued)

FOREIGN PATENT DOCUMENTS

JP 2002-52771 A 2/2002
JP 2005-169850 A 6/2005

OTHER PUBLICATIONS

International Search Report issued in related International Patent Application No. PCT/JP2016/001392, completed Jul. 14, 2016.

*Primary Examiner* — Lam Nguyen
(74) *Attorney, Agent, or Firm* — Foley & Lardner LLP

(57) ABSTRACT

A liquid spray device includes: a liquid spray head including a spray surface provided with a plurality of nozzles that spray liquid to a medium; a conveyance mechanism that includes an opposing surface opposite to the spray surface and conveys the medium in a first direction between the spray surface and the opposing surface; a plurality of protrusions protruding from the spray surface, and arranged in a second direction which is intersecting with the first direction; and a plurality of supports protruding from the opposing surface to support the medium being conveyed, and arranged in the second direction. The protrusions each have at least a part overlapping with a position other than a middle area between the supports adjacent to each other.

8 Claims, 5 Drawing Sheets

(51) Int. Cl.

| | |
|---|---|
| ***B41J 2/175*** | (2006.01) |
| ***B41J 11/00*** | (2006.01) |
| *B41J 11/42* | (2006.01) |

(56) References Cited

U.S. PATENT DOCUMENTS

| | | | | |
|---|---|---|---|---|
| 5,940,092 | A * | 8/1999 | Kashimura | B41J 11/20 347/8 |
| 6,181,908 | B1 * | 1/2001 | Leemhuis | B65H 29/70 271/188 |
| 6,471,315 | B1 * | 10/2002 | Kurata | B41J 2/04505 347/16 |
| 6,503,011 | B2 * | 1/2003 | Kono | B41J 13/106 271/188 |
| 2002/0012561 | A1 | 1/2002 | Saito | |
| 2013/0278654 | A1 | 10/2013 | Ito et al. | |

* cited by examiner

[Fig. 1]
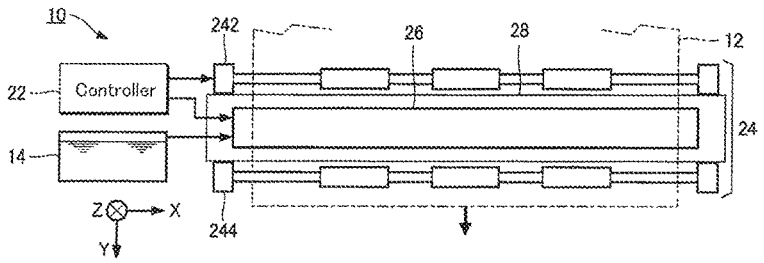
[Fig. 2]
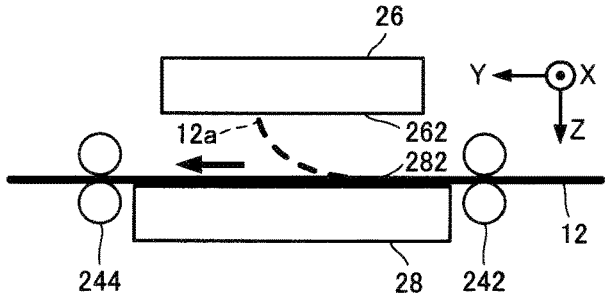
[Fig. 3]
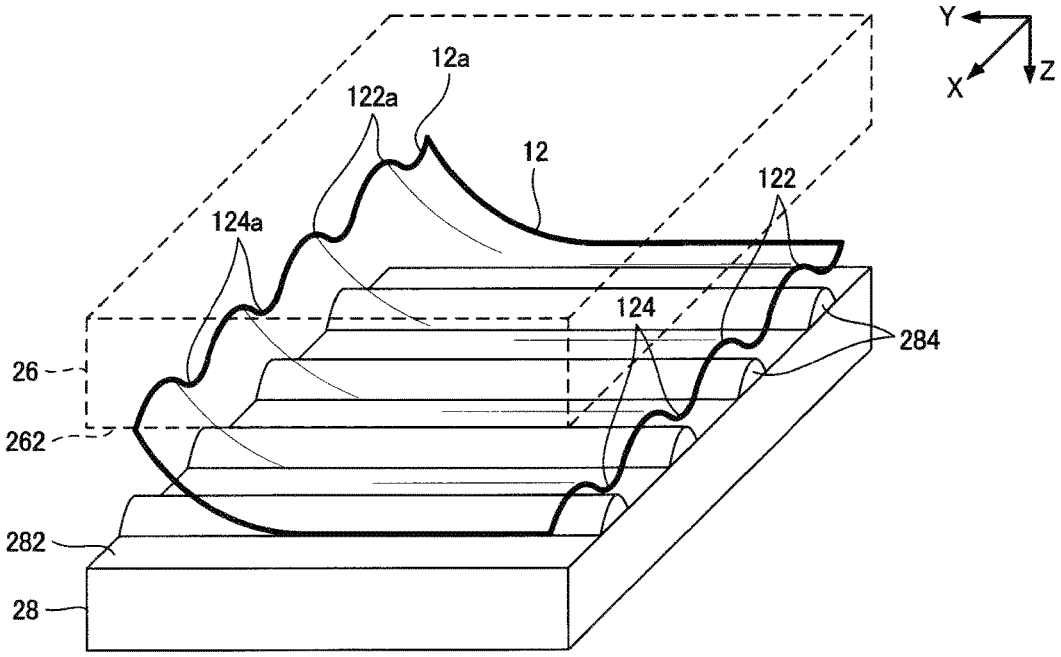

[Fig. 4]
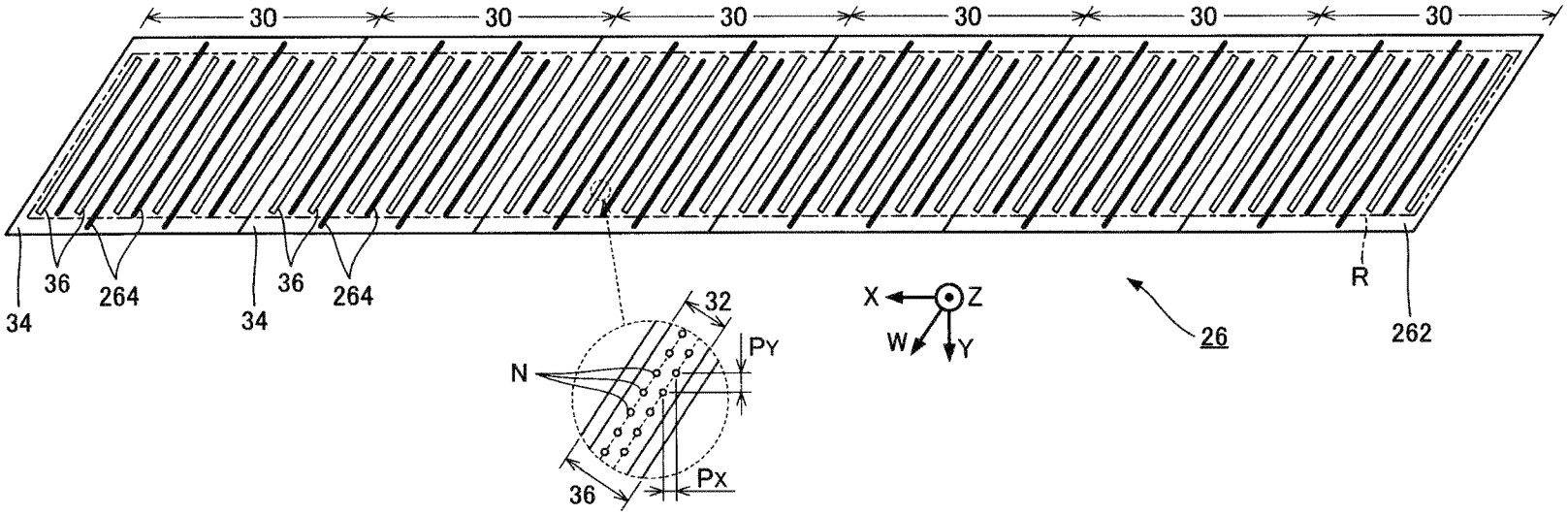

[Fig. 5]
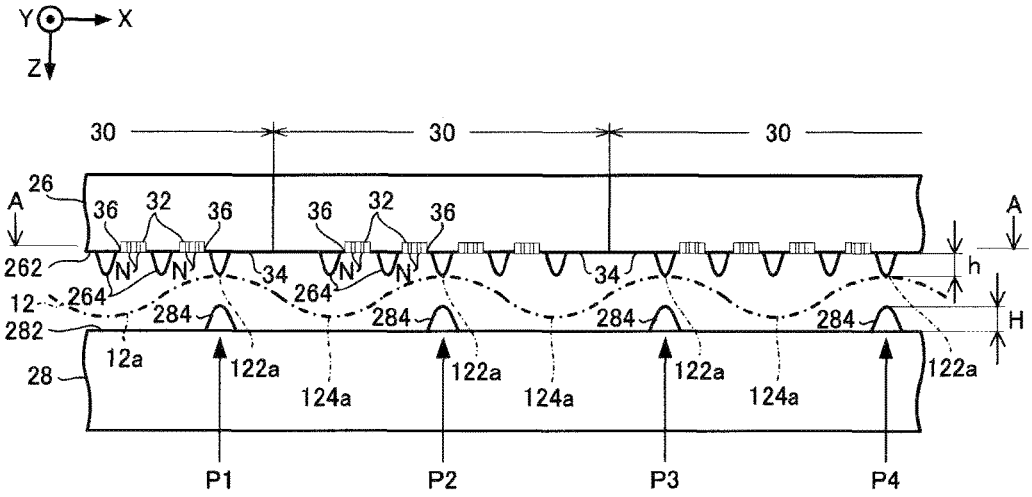
[Fig. 6]
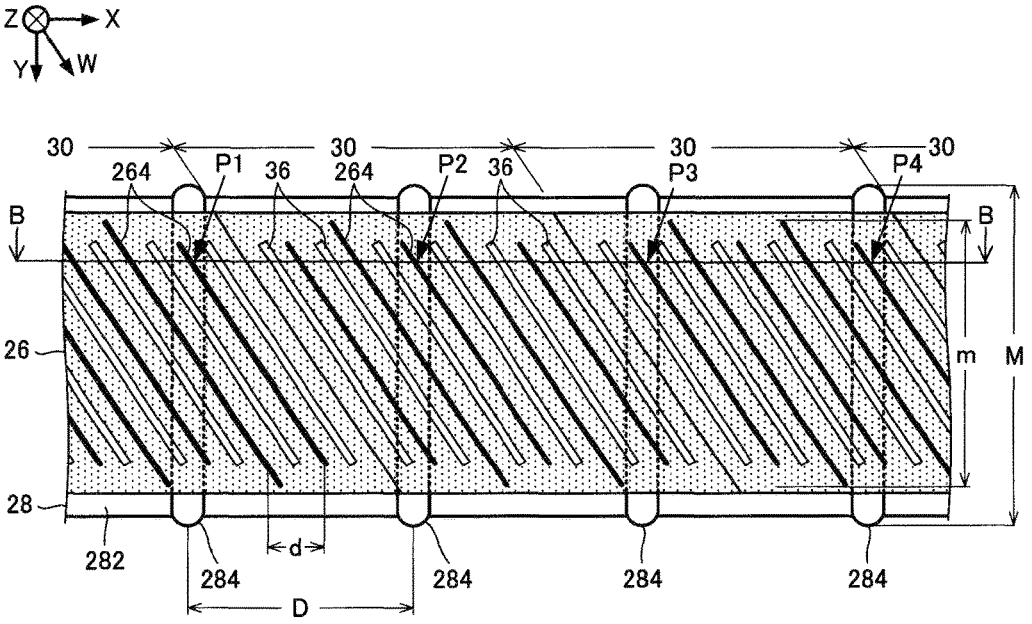

[Fig. 7]
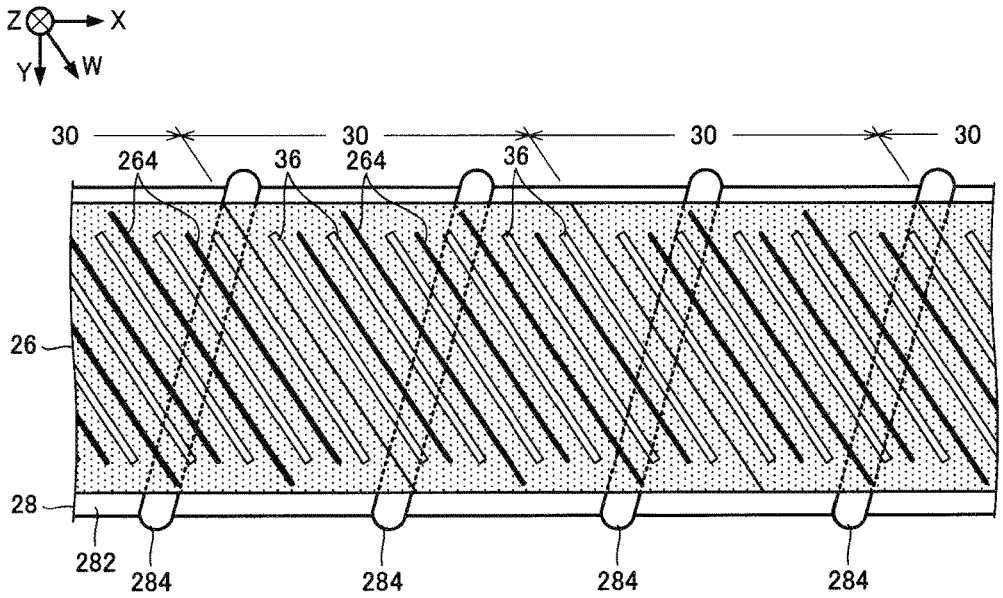
[Fig. 8]
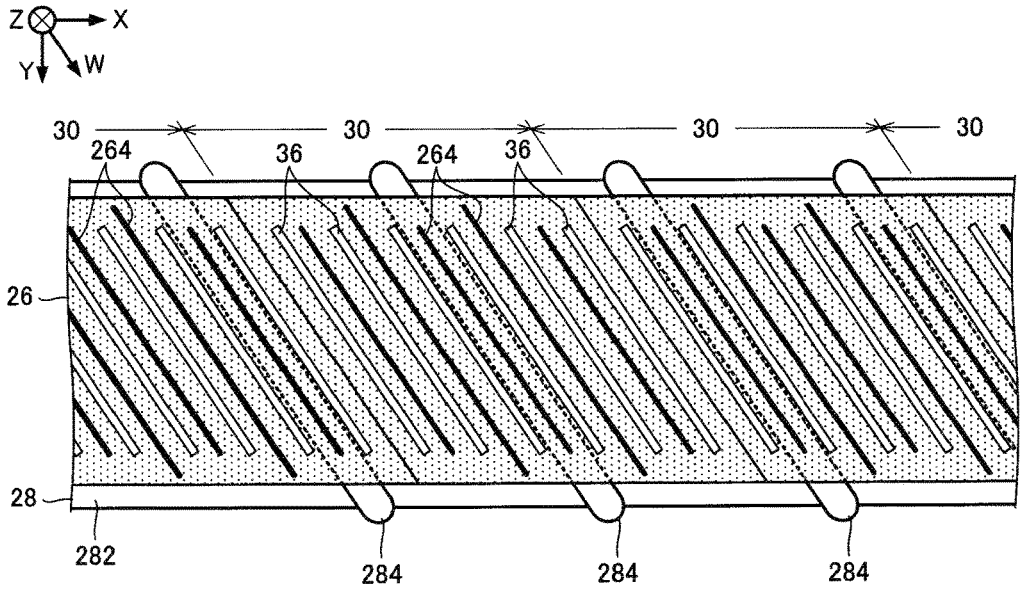

[Fig. 9]
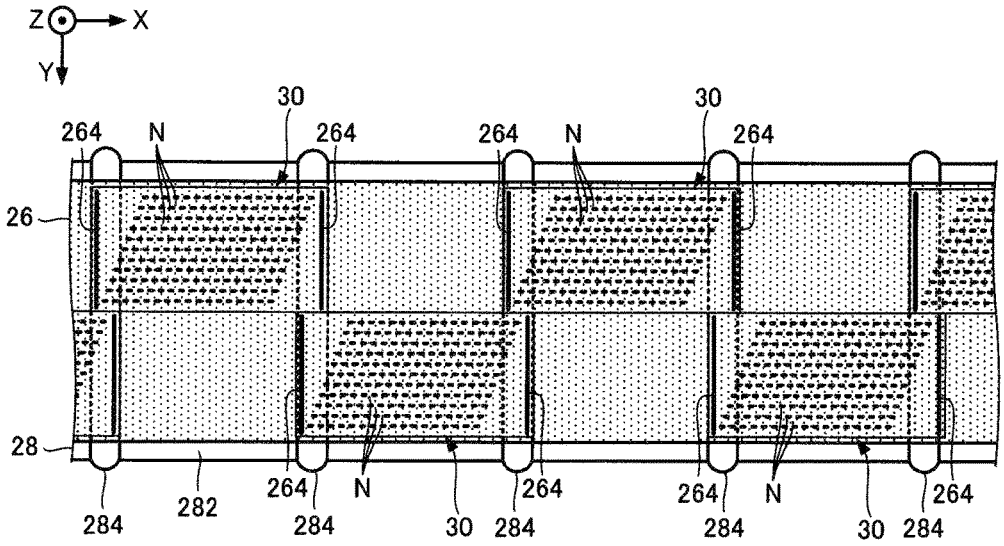
[Fig. 10]
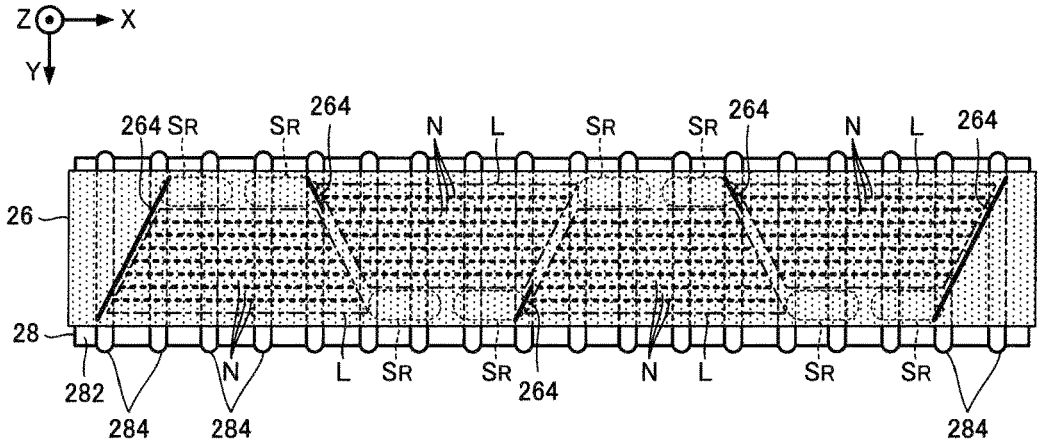

LIQUID SPRAY DEVICE

CROSS-REFERENCE TO RELATED APPLICATIONS

This application is the National Stage of International Patent Application No. PCT/JP2016/001392, filed Mar. 11, 2016, which claims priority from Japanese Patent Application No. 2015-058943, filed Mar. 23, 2015. The contents of these applications are incorporated by reference in their entirety.

TECHNICAL FIELD

The present invention relates to a technique of spraying liquid such as ink.

BACKGROUND ART

In a liquid spray device such as an ink-jet printer, a liquid spray head sprays liquid such as ink onto a medium such as a print sheet. This may cause a phenomenon called cockling in which the sheet swells due to the liquid, and gets a wavy surface with convex parts and concave parts. For example, PTL 1 discloses a configuration in which a platen opposite to a spray surface of the liquid spray head through which the liquid is sprayed is provided with a plurality of ribs arranged at a regular pitch determined with a positional relation between the ribs and a sheet feed roller taken into consideration. A sheet is conveyed by the roller while being supported by the ribs of the platen, whereby the sheet is shaped such that a cockling pattern (pattern formed by the convex parts and the concave parts) can match the pitch of the ribs, thereby suppressing excess cockling of the sheet.

SUMMARY OF INVENTION

Technical Problem

A sheet having a curled leading edge is conveyed between the liquid spray head and the platen in some cases. In such a case, the curled leading edge of the sheet may be uplifted while keeping cockling even by use of the ribs of the platen regularly arranged to match the cockling pattern of the sheet with the pitch of the ribs as disclosed in PTL 1. Thus, when the sheet has a large uplift deformation, the leading edge of the sheet may contact the spray surface of the liquid spray head, and may be contaminated due to adhesion of the ink remaining on the spray surface. An advantage of some aspects of the invention is to reduce the uplift deformation of a medium and to reduce contact of the medium with the spray surface.

Solution to Problem

Aspect 1

To solve the above-mentioned problem, a liquid spray device according to an aspect (Aspect 1) of the invention includes a liquid spray head including a spray surface provided with a plurality of nozzles that sprays liquid to a medium, a conveyance mechanism that includes an opposing surface opposite to the spray surface and conveys the medium in a first direction between the spray surface and the opposing surface, a plurality of protrusions protruding from the spray surface and arranged in a second direction which is intersecting with the first direction, and a plurality of supports protruding from the opposing surface to support the medium being conveyed, and arranged in the second direction. The protrusions each have at least a part overlapping with a position other than middle area between the supports adjacent to each other. In Aspect 1, since the liquid spray device includes the protrusions protruding from the spray surface of the liquid spray head and arranged in a second direction which is intersecting (orthogonally or at a tilt) with the first direction, and the supports protruding from the opposing surface of the conveyance mechanism to support the medium being conveyed, and arranged in the second direction, the medium is conveyed between the supports and the protrusions of the spray surface while being supported by the supports. With this configuration, the uplift deformation of the medium can be reduced by the supports and the protrusions, thereby reducing contact of the medium with the spray surface. This can reduce adhesion of the liquid remaining on the spray surface to the medium.

In Aspect 1, since the medium is conveyed while being supported by the protruding supports, the medium is shaped in a wavy manner by the supports. Specifically, parts of the medium on the supports become convex parts of the wavy shape (cockling shape), whereas a part thereof corresponding to a middle area between the supports adjacent to each other becomes a concave part of the wavy shape. In this point, since the protrusions each have at least a part overlapping with a position other than the middle area between the supports adjacent to each other according to Aspect 1, even when the medium is curled, the protrusions do not contact the concave parts of the wavy shape of the medium, but contact parts other than the concave parts (for example, the convex parts of the medium and their vicinities), thereby preventing the medium from reaching the spray surface. In this manner, the protrusions can appropriately reduce the uplift deformation of the convex parts and their vicinities of the wavy shape of the medium, which are likely to contact the spray surface when the medium is curled. Accordingly, the uplift deformation of the medium can be effectively reduced as compared to a case in which, for example, the protrusions overlap only with a middle area between the supports adjacent to each other (case in which the protrusions overlap only with the concave parts of the wavy shape of the medium), thereby enhancing the effect of reducing contact of the medium with the spray surface.

Aspect 2

In an example (Aspect 2) of Aspect 1, an interval of the supports in the second direction is larger than an interval of the protrusions in the second direction. In Aspect 2, since the interval of the supports in the second direction is larger than the interval of the protrusions in the second direction, the number of the supports that contact the medium can be reduced, and accordingly a decrease in conveying performance due to contact friction between the supports and the medium being conveyed on the supports can be reduced. In addition, since the number of the protrusions is larger than the number of the supports, the number of the protrusions is larger than the number of the convex parts of the wavy shape of the medium which is shaped by the supports. Accordingly, the number of parts of the protrusions contact the convex parts of the wavy shape of the medium becomes large, and thereby the effect of reducing contact of the medium with the spray surface can be enhanced.

Aspect 3

In an example (Aspect 3) of Aspect 1 or Aspect 2, a height of the supports protrude from the opposing surface is higher than a height of the protrusions protrude from the spray surface. In Aspect 3, since the height of the supports protruding from the opposing surface is higher than the height of the protrusions protruding from the spray surface, the convex parts and concave parts of the wavy shape of the medium can be reliably formed, and thereby the shaping of the medium is facilitated. In addition, such low heights of the protrusions lead to a reduced distance between the medium and the spray surface. Accordingly, errors in the landing positions of sprayed liquid can be reduced, and thus degradation of the quality of a printed image can be reduced.

Aspect 4

In an example (Aspect 4) of any of Aspect 1 to Aspect 3, a region in which the supports are provided in the first direction covers a region in which the protrusions are provided. In Aspect 4, since the region in which the supports are provided in the first direction covers the region in which the protrusions are provided, the shaping of the medium by the supports can be effectively performed on both the upstream side (where the medium enters the region of the protrusions) and the downstream side (the medium leaves the region of the protrusions) in the first direction in which the medium is conveyed.

Aspect 5

In an example (Aspect 5) of any of Aspect 1 to Aspect 4, in the second direction, the protrusions have parts crossing over the supports. In Aspect 5, in the second direction, since the protrusions have parts crossing over the supports, the protrusions do not contact the convex parts of the wavy shape of the medium in the second direction even when the medium is curled, thereby preventing the medium from reaching the spray surface. In this manner, the protrusions can appropriately reduce the uplift deformation of the convex parts of the wavy shape of the medium, which are likely to contact the spray surface when the medium is curled. Accordingly, the uplift deformation of the medium can be effectively reduced, thereby enhancing the effect of reducing contact of the medium with the spray surface.

Aspect 6

In an example (Aspect 6) of Aspect 5, parts of the protrusions, which cross over with the supports in the second direction, are arranged upstream in the first direction. In Aspect 6, since the parts of the protrusions, which overlap with the supports in the second direction, are arranged upstream in the first direction, the medium can be early prevented from contacting part of the spray surface, on which the protrusions are not arranged.

Aspect 7

In an example (Aspect 7) of any of Aspect 1 to Aspect 6, the protrusions are arranged at a tilt relative to the first direction. In Aspect 7, since the protrusions are arranged at a tilt relative to the first direction, the entire installation region (installation area) of the protrusions can be reduced in the convey direction as compared to when the protrusions are arranged parallel to the first direction, thereby facilitating contact of the protrusions with the medium.

Aspect 8

In an example (Aspect 8) of any of Aspect 1 to Aspect 7, the supports are arranged parallel to the first direction. In Aspect 8, since the supports are arranged parallel to the first direction, the shaping of the medium is facilitated, thereby reducing (oblique) movement of the medium being conveyed, in a direction tilted relative to the conveyance direction. The liquid spray device may be a printer that sprays ink onto the medium such as print sheet, but the usage of the liquid spray device according to an Aspect of the invention is not limited to printing.

BRIEF DESCRIPTION OF DRAWINGS

FIG. 1 is a configuration diagram of a printer to which a liquid spray device according to a first embodiment of the invention is applied.

FIG. 2 is an explanatory diagram of operation of the printer illustrated in FIG. 1, particularly illustrating conveyance of a medium.

FIG. 3 is an enlarged perspective diagram of part of the printer illustrated in FIG. 2, for describing a relation between ribs of a platen and the medium.

FIG. 4 is a plan view illustrating a specific configuration example of a spray surface of a liquid spray head in the first embodiment.

FIG. 5 is a sectional view illustrating a relation between protrusions of the liquid spray head and the ribs of the platen, for describing the configuration of the spray surface of the liquid spray head and an opposing surface of the platen in the first embodiment.

FIG. 6 is a sectional view taken along line A-A illustrated in FIG. 5.

FIG. 7 is a diagram illustrating the configuration of the spray surface of the liquid spray head and the opposing surface of the platen in a variation of the first embodiment.

FIG. 8 is a diagram illustrating the configuration of the spray surface of the liquid spray head and the opposing surface of the platen in another variation of the first embodiment.

FIG. 9 is a diagram illustrating the configuration of the spray surface of the liquid spray head and the opposing surface of the platen in a liquid spray device according to a second embodiment of the invention.

FIG. 10 is a diagram illustrating the configuration of the spray surface of the liquid spray head and the opposing surface of the platen in a third embodiment of the invention.

DESCRIPTION OF EMBODIMENTS

First Embodiment

Description will be first made of an ink-jet printer as an example of a liquid spray device according to a first embodiment of the invention. FIG. 1 is a configuration diagram of part of a printer 10 according to the first embodiment of the invention. FIG. 2 is an explanatory diagram of operation of the printer illustrated in FIG. 1, particularly illustrating conveyance of a medium. FIG. 3 is an enlarged perspective diagram of part of the printer illustrated in FIG. 2, for describing a relation between ribs of a platen and the medium. As illustrated in FIG. 1, the printer 10 includes a liquid spray head 26 including a spray surface 262 that sprays ink as exemplary liquid onto a medium (spray target) 12 such as a print sheet, a conveyance mechanism 24 that conveys the medium 12 relative to the liquid spray head 26 such that the medium 12 keeps facing the spray surface 262, and a controller 22 that performs overall control of each component of the printer 10. The printer 10 also includes a liquid container (cartridge) 14 that stores ink and supplies the ink to the liquid spray head 26.

The conveyance mechanism 24 conveys the medium 12 toward a positive side of a Y direction as a conveyance direction (first direction) under control of the controller 22. As illustrated in FIGS. 1 and 2, the conveyance mechanism 24 includes a first roller 242 and a second roller 244. The first roller 242 is disposed on a negative side of the Y direction (upstream in the conveyance direction of the medium 12) relative to the second roller 244, and conveys the medium 12 toward the second roller 244. The second roller 244 conveys the medium 12 supplied from the first roller 242 toward the positive side of the Y direction. However, the structure of the conveyance mechanism 24 is not limited to this exemplary structure.

A platen 28 is disposed between the first roller 242 and the second roller 244, facing the spray surface 262 of the liquid spray head 26. As illustrated in FIG. 3, the platen 28 includes an opposing surface 282 opposite to the spray surface 262, from which a plurality of ribs 284 serving as supports for the medium 12 protrude. The ribs 284 each extend in parallel to the conveyance direction and are separated from each other at constant intervals in an X direction. The medium 12 is conveyed toward the positive side of the Y direction by the first roller 242 and the second roller 244, passing between the spray surface 262 and the opposing surface 282. During this conveyance, the medium 12 is supported by the ribs 284 and shaped to wave (cockle) at the intervals of the ribs 284. Specifically, as illustrated in FIG. 3, the medium 12 is shaped on the ribs 284 such that part of the medium 12 corresponding to a position at which each rib 284 is formed is raised to become a convex part 122, whereas part thereof corresponding to a position between the ribs 284 becomes a concave part 124.

Meanwhile, as illustrated by a dotted line in FIG. 2, the medium 12 may be conveyed between the first roller 242 and the second roller 244 while having a deformed (for example, curled) leading edge 12*a* in some cases. For example, during a process in which the medium 12 is sequentially inverted to have ink sprayed on its both sides (during duplex printing), the medium 12 is deformed particularly at a stage when ink is sprayed only on one side. When only one side is printed and ink is sufficiently dried, the deformation of the medium 12 can be reduced. It is, however, difficult in reality to have a sufficient drying time in, for example, fast printing in which a large number of media 12 are printed in a short time. The conveyance mechanism 24 thus needs to convey the medium 12 while the medium 12 is deformed toward the liquid spray head 26.

In this case, as illustrated in FIG. 3, the medium 12 is conveyed while the leading edge 12*a* thereof has a shape corresponding to the wavy shape (cockling shape) of parts of the medium 12 supported by the ribs 284. Specifically, the convex part 122 of the medium 12 supported by each rib 284 makes a convex part 122*a* of the leading edge 12*a* appear, and the concave part 124 thereof makes a concave part 124*a* of the leading edge 12*a* appear. Thus, when curled largely, the leading edge 12*a* of the medium 12 may potentially contact the spray surface 262 of the liquid spray head 26, whereby any remaining ink on the spray surface 262 may adhere to the medium 12.

In the first embodiment, a protrusion from the spray surface 262 is formed to reduce the uplift deformation of the medium 12 so that the medium 12 does not contact the spray surface 262. This can effectively reduce the ink adhesion to the medium 12. Particularly when the medium 12 is shaped in a cockling manner by the ribs 284 of the platen 28 as illustrated in FIG. 3, the convex part 122*a* of the leading edge 12*a* of the medium 12 and its vicinity is likely to contact the spray surface 262. Therefore, in the first embodiment, in order to exploit this tendency, the protrusions of the spray surface 262 are arranged at positions corresponding to the arrangement positions of the ribs 284 of the platen 28. The protrusions and ribs provide a synergistic effect of appropriately reducing the uplift deformation of the medium 12 and the contact of the medium 12 with the spray surface 262.

Next follows a description of a specific configuration example of the liquid spray head 26 including the above-mentioned protrusions. FIG. 4 is a plan view of the spray surface 262 from underneath (a negative side of a Z direction), illustrating a specific configuration example of the liquid spray head 26 in the first embodiment. Note that the Z direction is a direction orthogonal to an X-Y plane formed by the X and Y directions. The Z direction corresponds to a direction (for example, toward a bottom side of the vertical direction) in which the liquid spray head 26 sprays ink. The Y direction corresponds to the transverse direction of a region (hereinafter, referred to as "nozzle-distributed region") R, across which a plurality of nozzles N are distributed, of the spray surface 262 of the liquid spray head 26. The X direction corresponds to the longitudinal direction of the nozzle-distributed region R.

The liquid spray head 26 illustrated in FIG. 4 is a line head elongated in the X direction (the second direction) orthogonal to the Y direction, and including a plurality of (six, in this example) divided head units 30. The head units 30 are arranged at predetermined intervals to be parallel to the X-Y plane and opposite to the medium 12. While the conveyance mechanism 24 conveys the medium 12, the liquid spray head 26 sprays ink to the medium 12, thereby forming a desired image on a surface of the medium 12. Each head unit 30 is provided with the nozzles N that spray ink supplied by the liquid container 14. The head unit 30 includes a plurality of liquid spray units (head chips) attached to a fixed plate 34 and each spray unit includes a nozzle plate 32 in which the nozzles N are formed.

Specifically, as illustrated in an enlarged diagram in FIG. 4, a plurality of opening portions 36 are formed on the fixed plate 34, and the liquid spray units each including the nozzle plate 32 are attached so that the nozzles N are exposed out of the opening portions 36. The nozzles N are arrayed in two lines in a W direction intersecting with the X direction. The W direction illustrated in FIG. 4 is in the X-Y plane and tilted at a predetermined angle (for example, an angle in a range of 30° to 60° inclusive) relative to the X direction and the Y direction. The nozzles N are selectively positioned such that a pitch (specifically, a distance between centers of the nozzles N) PX in the X direction is smaller than a pitch PY in the Y direction (PX<PY). In this manner, the nozzles N are arrayed in the W direction tilted relative to the Y direction in which the medium 12 is conveyed, and this configuration can achieve a higher effective resolution (dot density) of the medium 12 in the X direction as compared to a configuration in which the nozzles N are arrayed in, for example, the X direction.

Each protrusion 264 of the liquid spray head 26 illustrated in FIG. 4 is provided between the opening portions 36. The protrusion 264 is formed in an elongated shape (straight line), extending in the W direction similarly to the opening portions 36. In this manner, the protrusion 264 is arranged between the opening portions 36, thereby effectively reducing adhesion of the ink remaining in the opening portions 36 to the medium 12. The protrusions 264 are in an alternate arrangement of a protrusion having the same length (total length) in the W direction as the length of the opening portions 36 in the W direction and arranged inside the nozzle-distributed region R, and a protrusion having a length longer than the length of the opening portions 36 and extending outside the nozzle-distributed region R. The protrusions 264 may be formed integrally with or separately from the fixed plate 34.

Next follows a description of a relation between the protrusions 264 of the liquid spray head 26 and the ribs (supports) 284 of the platen 28. FIGS. 5 and 6 are diagrams for describing the configuration of the spray surface 262 of the liquid spray head 26 and the opposing surface 282 of the platen 28 in the first embodiment, and are sectional views illustrating the relation between the protrusions 264 and the ribs 284. FIG. 6 illustrates a section taken along line A-A (the X-Y plane including the opening portions 36 of the fixed plate 34) illustrated in FIG. 5, and viewed from above (a positive side of the Z direction). FIG. 5 is a sectional view taken along line B-B illustrated in FIG. 6.

As illustrated in FIG. 5, the protrusions 264 are provided to protrude from the spray surface 262 (the fixed plate 34 of each head unit 30) toward the platen 28 (the positive side of the Z direction). In contrast, the ribs 284 of the platen 28 are provided to protrude from the opposing surface 282 opposite to the spray surface 262 toward the spray surface 262 (a negative side of the Z direction). In this arrangement, the medium 12 is sandwiched between the protrusions 264 on the spray surface 262 and the ribs 284 of the platen 28, as illustrated in FIG. 5, thereby preventing any curled leading edge 12*a* of the medium 12 from contacting the spray surface 262. This can reduce adhesion of the ink remaining on the spray surface 262 to the medium 12.

As illustrated in FIG. 6, the protrusions 264 on the spray surface 262 in the first embodiment are tilted relative to the ribs 284 of the platen 28 and arranged so that part of at least one of the protrusions 264 crosses over the ribs 284 in the X direction (direction in which the protrusions 264 and the ribs 284 are arrayed) and overlaps with the ribs 284 when viewed in the Z direction. In FIG. 6, each rib 284 has parts that intersect and overlap with three protrusions 264. From left in FIG. 6, P1, P2, P3, and P4 represent positions most upstream in the conveyance direction (positive side of the Y direction) at which the ribs 284 overlap with the protrusions 264. These positions correspond to P1, P2, P3, and P4 illustrated in FIG. 5, respectively. As illustrated in FIG. 5, the medium 12 conveyed while being supported by the ribs 284 is shaped into a wavy shape by the ribs 284, and the wavy shape of the leading edge 12*a* has the convex parts 122*a* at the positions P1, P2, P3, and P4 on the ribs 284. These convex parts 122*a* of the medium 12 become closest to the spray surface 262 when the leading edge 12*a* of the medium 12 is curled and uplifted, and thus are most likely to contact the spray surface 262.

In this point, in the first embodiment, the protrusions 264 are arranged to overlap with the ribs 284 at the positions P1, P2, P3, and P4, thereby pressing down the convex parts 122*a* of the wavy shape of the medium 12. In this manner, the uplift deformation of the convex parts 122*a* of the medium 12, which are most likely to contact the spray surface 262, are reduced, thereby appropriately reducing contact of the medium 12 with the spray surface 262. The adhesion of the ink remaining on the spray surface 262 to the medium 12 can thus be effectively reduced.

As illustrated in FIG. 5, a height H of the ribs 284 of the platen 28 protrude from the opposing surface 282 is higher than a height h of the protrusions 264 protrude from the spray surface 262 (in other words, height from the spray surface 262 to the apexes of the protrusions 264). Such high heights of the ribs 284 enable a reliable formation of the convex parts 122*a* and the concave parts 124*a* of the wavy shape of the medium 12, and facilitate the shaping of the medium 12. In addition, such low heights of the protrusions 264 lead to shorten the distance between the medium 12 and the spray surface 262. This arrangement can reduce error in the landing position of sprayed ink, and thus reduce degradation of the quality of a printed image.

As illustrated in FIG. 6, an interval D of the ribs (supports) 284 of the platen 28 in the X direction (the second direction) is larger than an interval d of the protrusions 264 of the liquid spray head 26 in the X direction. This arrangement can reduce the number of the ribs 284 of the platen 28 which contact the medium 12, and thus can reduce a decrease in conveying performance due to contact friction between the ribs 284 and the medium 12 being conveyed on the ribs 284. In addition, since the number of the protrusions 264 is larger than the number of the ribs 284, the number of the protrusions 264 is larger than the number of the convex parts 122*a* of the wavy shape of the medium which is formed by the ribs 284. Accordingly, the larger number of parts of the protrusions 264 contact the convex parts 122*a* of the wavy shape of the medium 12, thereby enhancing the effect of reducing contact of the medium 12 with the spray surface 262.

As illustrated in FIG. 6, in the conveyance direction (Y direction), a region M in which the ribs 284 are provided covers a region m in which the protrusions 264 are provided. This allows the shaping of the medium 12 to be effectively performed by the ribs 284 on an upstream side (where the medium 12 enters the region m of the protrusions 264) and on a downstream side (where the medium 12 leaves the region m of the protrusions 264) in the conveyance direction in which the medium 12 is conveyed. As illustrated in FIG. 6, parts (for example, P1 to P4) of the protrusions 264 which cross over the ribs 284 in the X direction are positioned on the upstream side in the conveyance direction (Y direction), thereby preventing the medium 12 early from contacting part of the spray surface 262, on which the protrusions 264 are not arranged. Moreover, as illustrated in FIG. 6, the protrusions 264 are arranged at a tilt relative to the conveyance direction, thereby reducing the entire installation region (installation area) of the protrusions 264 in the conveyance direction as compared to when arranged parallel to the conveyance direction, and facilitating contact of the protrusions 264 with the medium 12. In addition, the ribs 284 are arranged parallel to the conveyance direction, thereby facilitating the shaping of the medium 12 and reducing (oblique) movement of the medium 12 being conveyed, in a direction tilted relative to the conveyance direction.

The first embodiment describes the example in which a plurality of protrusions 264 overlap with each rib 284, but the invention is not limited thereto. The configuration in which at least one of the protrusions 264 overlaps with the rib 284 can, as a whole, reduce the uplift deformation of the medium 12, thereby reducing contact of the medium 12 with the spray surface 262. Moreover, the protrusions 264 do not need to be arranged at positions corresponding to the convex parts 122*a* of the medium 12, but can be arranged at positions corresponding to the vicinities of the convex parts 122*a*, thereby, as a whole, reducing the uplift deformation of the medium 12. Thus, the protrusions 264 and the ribs 284 do not necessarily need to overlap with each other. The protrusions 264 need to be arranged not only at the positions corresponding to the concave parts 124*a* of the medium 12. Since the concave parts 124*a* of the medium 12 are each formed at the middle area between the ribs 284 adjacent to each other, the protrusions 264 need to be formed not only at the middles. Thus, in order to reduce contact of the medium 12 with the spray surface 262, the protrusions 264 each need to have at least a part overlapping with a position other than a middle area (central area) between the ribs 284 adjacent to each other.

As described above, the protrusions 264 are each arranged to have at least a part, when viewed in the Z direction, overlapping with a position other than the middle area between the ribs 284 adjacent to each other in the X direction. Consequently, even when the medium 12 is curled, the protrusions 264 do not contact the concave parts 124*a* of the wavy shape of the medium 12 in the X direction, but contact parts other than the concave parts (for example, the convex parts 122*a* of the medium and their vicinities), thereby preventing the medium 12 from reaching the spray surface 262. In this manner, the protrusions 264 can appropriately reduce the uplift deformation of the convex parts 122*a* and their vicinities of the wavy shape of the medium 12, which are likely to contact the spray surface 262 when the medium 12 is curled. Accordingly, this arrangement can effectively reduce the uplift deformation of the medium 12 as compared to a case in which, for example, the protrusions 264 each overlap only with the middle area between the ribs 284 adjacent to each other (case in which the protrusions 264 overlap only with the concave parts 124*a* of the wavy shape of the medium 12), and thereby enhance the effect of reducing contact of the medium 12 with the spray surface 262. As described above, in the first embodiment, the ribs 284 and the protrusions 264 provide a synergistic effect of reducing the uplift deformation of the medium 12, thereby effectively reducing contact of the medium 12 with the spray surface 262. In addition, when the apexes of the protrusions 264 are at positions corresponding to the convex parts 122*a* of the medium 12, this effect is more significant.

Moreover, the first embodiment describes the example in which each rib 284 of the platen 28 is parallel to the conveyance direction, but the invention is not limited thereto. For example, as illustrated in FIGS. 7 and 8, the rib 284 may be tilted relative to the conveyance direction. FIG. 7 illustrates a case in which each rib 284 of the platen 28 is tilted relative to the conveyance direction, and also to the protrusions 264. FIG. 8 illustrates a case in which each rib 284 of the platen 28 is tilted relative to the conveyance direction but is parallel to the protrusions 264. A plurality of protrusions 264 intersect and overlap with any one of the ribs 284 in the configurations in FIGS. 6 and 7, whereas one protrusion 264 overlaps with any one of the ribs 284 in parallel in the configuration in FIG. 8. With these configurations, the convex parts 122*a* of the wavy shape of the medium 12 can be pressed down by the protrusions 264 at positions where the protrusions 264 and the ribs 284 overlap with each other, similarly to the positions P1, P2, P3, and P4 illustrated in FIG. 5. In this manner, the uplift deformation of the convex parts 122*a* of the medium 12, which are most likely to contact the spray surface 262, is reduced, thereby appropriately reducing contact of the medium 12 with the spray surface 262.

Furthermore, as illustrated in FIG. 7, each rib 284 of the platen 28 is arranged at a tilt relative to the conveyance direction and also to the protrusions 264, thereby allowing a larger number of the protrusions 264 to overlap with the rib 284. This can increase an area in which the uplift deformation of the medium 12 is reduced by the ribs 284 and the protrusions 264 in the conveyance direction (Y direction). Alternatively, as illustrated in FIG. 8, each rib 284 of the platen 28 is arranged at a tilt relative to the conveyance direction but parallel to the corresponding protrusion 264, thereby achieving a constant distance between the rib 284 and the protrusion 264 from upstream to downstream in the conveyance direction. This allows the uplift deformation of the medium 12 to be reduced at a constant interval from upstream to downstream in the conveyance direction.

In FIG. 7 (in which the ribs 284 are tilted relative to the protrusions 264) and FIG. 8 (in which the ribs 284 parallel to the protrusions 264), the protrusions 264 and the ribs 284 do not necessarily need to overlap with each other. The protrusions 264 need to be arranged not only at the positions corresponding to the concave parts 124*a* of the medium 12. In other words, the protrusions 264 each need to have at least a part overlapping with a position other than the middle area between the ribs 284 adjacent to each other. Accordingly, the protrusions 264 and the ribs 284 provide the synergistic effect of, as a whole, reducing the uplift deformation of the medium 12, thereby reducing contact of the medium 12 with the spray surface 262.

Second Embodiment

Next follows a description of a second embodiment of the invention. In embodiments described below, note that any element having the same effect and function as those in the first embodiment is denoted by a reference numeral used in the description of the first embodiment, and a detailed description thereof will be omitted as appropriate. Although the first embodiment describes the example in which the protrusions 264 of the spray surface 262 are arranged at a tilt relative to the conveyance direction (Y direction), the second embodiment describes an example in which the protrusions 264 on the spray surface 262 are arranged parallel to the conveyance direction (Y direction). FIG. 9 is a sectional view for describing the configuration of the spray surface 262 and the opposing surface 282 in the second embodiment, illustrating the relation between the protrusions 264 and the ribs 284, and corresponds to FIG. 6. Similarly to the configuration in FIG. 6, the ribs 284 of the platen 28 in FIG. 9 are each parallel to the conveyance direction (Y direction). The liquid spray head 26 illustrated in FIG. 9 has a latticed array (what is called a staggered arrangement) of a plurality of the head units 30 on the spray surface 262 in the X direction. On the spray surface 262, the nozzles N are formed in the X-Y plane for each head unit 30.

On the spray surface 262 illustrated in FIG. 9, the protrusions 264 are formed on both sides of a region in which the nozzles N of each head unit 30 are formed. Similarly to the first embodiment, the protrusions 264 illustrated in FIG. 9 are formed to protrude from the spray surface 262 toward the opposing surface 282 of the platen 28. In FIG. 9, a plurality of protrusions 264 intersect and overlap with each rib 284 of the platen 28 when viewed in the Z direction. With this configuration, the convex parts 122*a* of the wavy shape of the medium 12 can be pressed down by the protrusions 264 at positions where the protrusions 264 and the ribs 284 overlap with each other, similarly to the positions P1, P2, P3, and P4 illustrated in FIG. 5. Thus, the configuration in FIG. 9 reduces the uplift deformation of the convex parts 122*a* of the medium 12, which are most likely to contact the spray surface 262, thereby appropriately reducing contact of the medium 12 with the spray surface 262.

Moreover, in the second embodiment, too, the protrusions 264 and the ribs 284 do not necessarily need to overlap with each other. The protrusions 264 need to be arranged not only at the positions corresponding to the concave parts 124*a* of the medium 12. In other words, the protrusions 264 each need to have at least a part overlapping with a position other than the middle area between the ribs 284 adjacent to each other. Accordingly, the protrusions 264 and the ribs 284 provide the synergistic effect of, as a whole, reducing the uplift deformation of the medium 12, thereby reducing the medium 12 from contacting the spray surface 262. Although FIG. 9 illustrates the example in which the ribs 284 are arranged parallel to the conveyance direction (Y direction), the invention is not limited thereto. The ribs 284 may be tilted relative to the conveyance direction (Y direction). The protrusions 264 may be arranged at a tilt or parallel relative to the ribs 284. The ribs 284 and the protrusions 264 may be both tilted relative to the conveyance direction (the positive side of the Y direction). The spray surface 262 in FIG. 9 may be a fixed plate that fixes the nozzle plate on which the nozzles N are formed as in the first embodiment, or may be the nozzle plate itself.

Third Embodiment

Next follows a description of a third embodiment of the invention. The third embodiment describes a case in which the interval of the ribs 284 of the platen 28 is smaller than the interval of the protrusions 264 on the spray surface 262. FIG. 10 is a sectional view for describing the configuration of the spray surface 262 and the opposing surface 282 in the third embodiment, illustrating the relation between the protrusions 264 and the ribs 284, and corresponds to FIG. 6. Similarly to the example in FIG. 6, the ribs 284 of the platen 28 in FIG. 10 corresponding to FIG. 6 are each parallel to the conveyance direction (Y direction). The liquid spray head 26 illustrated in FIG. 10 has a configuration different from those in FIG. 6 to FIG. 9, but may have the same configuration.

On the spray surface 262 illustrated in FIG. 10, a plurality of nozzle-distribution regions L are arrayed in the X direction. Each nozzle-distributed region L is a trapezoid (specifically, isosceles trapezoid) region in a plan view, and a positional relation between the upper base and the lower base of the trapezoid region is inverted across the nozzle-distributed regions L adjacent to each other in the X direction. In the nozzle-distributed region L, the nozzles N are formed in the X and Y directions. The liquid spray head 26 illustrated in FIG. 10 includes a plurality of storage chambers SR. Each storage chamber SR is a space for storing ink to be sprayed from the nozzles N. Specifically, the storage chamber SR is formed at a position corresponding to an apex of the nozzle-distributed region L in a plan view (viewed in a direction orthogonal to the spray surface). Ink distributed from the storage chamber SR into a plurality of passages is sprayed through the respective nozzles N.

On the spray surface 262 illustrated in FIG. 10, the protrusions 264 are formed between the nozzle-distributed regions L. Similarly to the first embodiment, the protrusions 264 illustrated in FIG. 10 are formed to protrude from the spray surface 262 toward the opposing surface 282 of the platen 28. Since each nozzle-distributed region L is a trapezoid and its arrangement is alternately inverted, the tilt of each protrusion 264 is alternately inverted in accordance with the tilt of a side of the trapezoid. As for the length of the protrusion 264 illustrated in FIG. 10, the protrusions 264 positioned at both ends of the spray surface 262 each have the length of the nozzle-distributed region L, whereas the protrusions 264 positioned between the nozzle-distributed regions L are formed shorter than the protrusions 264 positioned at the both ends. Thus, since space for formation of the protrusions 264 does not need to be provided between the nozzle-distributed regions L, the nozzle-distributed regions L can be disposed close to each other so as to advantageously achieve an arrangement with a high density of the nozzles N. Alternatively, the protrusions 264 positioned between the nozzle-distributed regions L may have the same length as that of the protrusions 264 positioned at the both ends.

In FIG. 10, a plurality of protrusions 264 intersect and overlap with the ribs 284 of the platen 28. With this configuration, the convex parts 122*a* of the wavy shape of the medium 12 can be pressed down by the protrusions 264 at positions where the protrusions 264 and the ribs 284 overlap with each other, similarly to the positions P1, P2, P3, and P4 illustrated in FIG. 5. Thus, the configuration in FIG. 10 reduces the uplift deformation of the convex parts 122*a* of the medium 12, which are most likely to contact the spray surface 262, thereby appropriately reducing contact of the medium 12 with the spray surface 262.

Moreover, in FIG. 10, since the interval of the ribs 284 of the platen 28 is smaller than the interval of the protrusions 264 on the spray surface 262, excess cockling of the medium 12 is reduced as compared to a case in which the ribs 284 has a larger interval. This can facilitate reduction of the uplift deformation of the medium 12 by the protrusions 264 and the ribs 284. As in the first embodiment, the spray surface 262 in FIG. 10 may be a fixed plate that fixes the nozzle plate on which the nozzles N are formed, or may be the nozzle plate itself.

The first to the third embodiments exemplified above are each comprehensively described as the configuration including the protrusions that protrude from the spray surface of the liquid spray head, and the ribs (supports) that protrude from the opposing surface of the platen, and thus the functions and usages of members forming the spray surface and the opposing surface are not specified. The various components (for example, the protrusions) exemplified above in each embodiment are applied irrespective of whether the spray surface is formed as the fixed plate or the nozzle plate as in the first to the third embodiments.

Variations

The embodiments exemplified above can have several variations. The following examples describe specific aspects of the variations. Two or more aspects optionally selected from the examples can be combined as appropriate to the extent that they do not contradict each other.

(1) The shape (length and section) of each protrusion 264 of the liquid spray head 26 is not limited to the examples in the first to third embodiments described above. For example, the protrusion 264 may have a sectional shape of a rectangle, a triangle, or a semicircle. The protrusion 264 may have an alternately changing length as illustrated in FIG. 6, or all the protrusions 264 may have the same length. Alternatively, the protrusions 264 may have lengths that are longer at positions closer to the ribs 284. Accordingly, the protrusions 264 and the ribs 284 can overlap with each other at an increased number of positions.

(2) The shape (length and section) of each rib (support) 284 of the platen 28 is not limited to the examples in the first to third embodiments described above. For example, the rib 284 may have a sectional shape of a rectangle, a triangle, or a semicircle. The ribs 284 do not necessarily need to have the same length. For example, a long rib and a short rib may be alternately provided. Moreover, in the first to third embodiments, each rib 284 has a length slightly larger than the width of the platen 28 in the conveyance direction, but is not limited thereto, and may have a length shorter than the width of the platen 28 in the conveyance direction.

(3) The printer 10 exemplified in each embodiment may be adopted in a device dedicated to printing and various devices such as facsimile and photocopier. The usage of the liquid spray device according to an Aspect of the invention is not limited to printing. For example, a liquid spray device that sprays color material solution is used as a manufacturing apparatus that produces a color filter of a liquid crystal display apparatus. Alternatively, a liquid spray device that sprays conductive material solution is used as a manufacturing device that produces wiring and electrodes on a wiring substrate.

REFERENCE SIGNS LIST

10 printer, 12 medium, 12*a* leading edge, 122, 122*a* convex part, 124, 124*a* concave part, 14 liquid container, 22 controller, 24 conveyance mechanism, 26 liquid spray head, 262 spray surface, 264 protrusion, 28 platen, 282 opposing surface, 284 rib, 30 head unit, 32 nozzle plate, 34 fixed plate, 36 opening portion, L nozzle-distributed region, R nozzle-distributed region, SR storage chamber

CITATION LIST

Patent Literature

[PTL 1] JP-A-2002-52771

The invention claimed is:

1. A liquid spray device comprising:

a liquid spray head including a spray surface provided with a plurality of nozzles that spray liquid to a medium;

a conveyance mechanism that includes an opposing surface opposite to the spray surface and conveys the medium in a first direction between the spray surface and the opposing surface;

a plurality of protrusions protruding from the spray surface, and arranged in a second direction which is intersecting with the first direction; and a plurality of supports arranged in the second direction, and protruding from the opposing surface to support the medium being conveyed, wherein the protrusions each have at least a part overlapping with a position other than a middle area between the supports adjacent to each other.

2. The liquid spray device according to claim 1, wherein an interval of the supports in the second direction is larger than an interval of the protrusions in the second direction.

3. The liquid spray device according to claim 1, wherein a height of the supports protruding from the opposing surface is higher than a height of the protrusions protruding from the spray surface.

4. The liquid spray device according to claim 1, wherein in the first direction, a region in which the supports are provided covers a region in which the protrusions are provided.

5. The liquid spray device according to claim 1, wherein the protrusions have parts crossing over the supports in the second direction.

6. The liquid spray device according to claim 5, wherein the parts of the protrusions crossing over the supports in the second direction are arranged on an upstream side in the first direction.

7. The liquid spray device according to claim 1, wherein the protrusions are arranged at a tilt relative to the first direction.

8. The liquid spray device according to claim 1, wherein the supports are arranged parallel to the first direction.

* * * * *